United States Patent [19]

Nishikawa et al.

[11] 4,136,320

[45] Jan. 23, 1979

[54] METHOD OF CONSTRUCTING DIELECTRIC RESONATOR UNIT AND DIELECTRIC RESONATOR UNIT PRODUCED THEREBY

[75] Inventors: Toshio Nishikawa, Nagaokakyo; Youhei Ishikawa; Sadahiro Tamura, both of Kyoto, all of Japan

[73] Assignee: Murata Manufacturing Co., Ltd., Nagaokakyo, Japan

[21] Appl. No.: 805,573

[22] Filed: Jun. 10, 1977

[30] Foreign Application Priority Data

Jun. 14, 1976 [JP] Japan ..... 51-70261

[51] Int. Cl.[2] ..... H01P 1/30; H01P 7/00

[52] U.S. Cl. ..... 333/82 BT; 29/600; 333/73 R

[58] Field of Search ..... 333/73 R, 82 BT, 83 T; 29/600

[56] References Cited

U.S. PATENT DOCUMENTS 3,840,828 10/1974 Linn et al. ..... 333/82 BT

*Primary Examiner*—Paul L. Gensler

*Attorney, Agent, or Firm*—Wenderoth, Lind & Ponack

[57] ABSTRACT

A dielectric resonator unit for use in electrical filters which includes a dielectric resonator made of ceramic material and a supporting spacer made of other types of ceramic material or synthetic resin. The supporting spacer is formed in the shape of a cylinder and has one end thereof bonded onto the dielectric resonator and the other end thereof bonded onto an inner surface of the casing of the filter. The combination of a particular dielectric resonator with a particular supporting spacer is determined by the value of temperature-frequency characteristics and temperature dielectric constant characteristics of the respective resonator and spacer, so that the resulting dielectric resonator unit has values of substantially Oppm/° C for both characteristics.

8 Claims, 4 Drawing Figures

METHOD OF CONSTRUCTING DIELECTRIC RESONATOR UNIT AND DIELECTRIC RESONATOR UNIT PRODUCED THEREBY

The present invention relates to a microwave band-pass filter, and more particularly, to a dielectric resonator unit, including a dielectric resonator and a supporting spacer therefor, to be employed in a filter, and also to a method of combining a particular dielectric resonator with a particular supporting spacer.

It is well known that a microwave band-pass filter utilizes one or more resonators made of dielectric material.

Generally, in the manufacture of dielectric resonators to be employed in electrical filters, each of the produced dielectric resonators has imparted thereto temperature-resonance frequency characteristics and thus has any inherent temperature coefficient of resonance frequency (referred to as the inherent TCF or simply the TCF herinbelow and expressed in units of ppm/° C.), due to the degree of purity of the original material and the conditions during the manufacturing, steps and other factors. Accordingly, the produced dielectric resonators may have a variation of TCF within a range of, for example, ±3ppm/° C. In a similar manner, each of the produced dielectric resonators has temperature-dielectric constant characteristics and thus has an inherent temperature coefficient of dielectric constant (referred to as the inherent TCϵ or simply the TCϵ hereinbelow and also expressed in ppm/° C.), and thus, the dielectric resonators thus produced may have a variation of TCϵ within a range of, for example, ±3ppm/° C.

In order to obtain dielectric resonators of a high quality, that is dielectric resonators having hardly any variations in resonance frequency or dielectric constant due to a change of the temperature, it has been conventionally necessary to select dielectric resonators with values of approximately 0ppm/° C. for the TCF and TCϵ from among all the dielectric resonators produced.

Accordingly, a comparatively high manufacturing cost is required to construct a filter employing such high quality dielectric resonators.

It is, therefore, a primary object of the present invention to provide a dielectric resonator unit to be employed in a microwave filter having a value of approximately 0ppm/° C. for the TCF and TCϵ, regardless of variations of the TCF and TCϵ of the dielectric resonator included in the dielectric resonator unit.

It is another object of the present invention to provide a dielectric resonator of the above described type which has a simple construction and can be produced at a low manufacturing cost.

In order to accomplish these and other objects, the dielectric resonator unit of the present invention is provided which comprises a dielectric resonator made of ceramic material and a supporting spacer made of another type of ceramic material or synthetic resin and being bonded or screwed, at one end thereof, onto the dielectric resonator and at the other end thereof onto the inner surface of a casing of the microwave band-pass filter in which it is used.

According to the present invention, the dielectric resonator unit having a value of approximately 0ppm/° C. for the TCF and TCϵ is produced by the steps of; (a) preparing a reference supporting spacer having a TCϵ of 0ppm/° C. (b) selecting a reference dielectric resonator having a TCF of 0ppm/° C. from among a plurality of dielectric resonators by coupling of said reference supporting spacer with various dielectric resonators; (c) measuring the change of TCF of the reference dielectric resonator when coupling the reference dielectric resonator with different supporting spacers and assigning the measured change of TCF, namely an apparent temperature frequency characteristic (referred to as TCF'), to each of the different supporting spacers as an indication of the degree for which it affects the TCF of the dielectric resonator; (d) measuring the TCF of the different dielectric resonators when said reference supporting spacer is coupled with the different dielectric resonators; and (e) coupling one of the dielectric resonators with a selected one of the supporting spacers, for causing the dielectric resonator to reduce the TCF of the thus formed dielectric resonator unit to be close to 0ppm/° C. For example, when a particular dielectric resonator measured in step (d), has a TCF of a +a(ppm/° C.), is joined with a corresponding supporting spacer selected from a group of supporting spacers obtained through the step (c) and having a TCF' of −a(ppm/° C.), the thus obtained dielectric resonator unit will have a TCF which is the sum of TCFs −a and +a, which is substantially 0ppm/° C.

In regard to the TCϵ, the TCϵ of each of the dielectric resonators as well as the supporting spacers is previously measured and the spacers and resonators are also chosen so that when they are used to construct the dielectric resonator unit the resulting TCϵ of the unit is substantially 0ppm/° C.

These and other objects and features of the present invention will become apparent from the following description of a preferred embodiment thereof taken in conjunction with the accompanying drawings, in which;

FIG. 2(*b*) is a sectional front view taken along the line II(*b*) — II(*b*) of FIG. 2(*a*)

Before the description of the present invention proceeds, it should be noted that like parts are designated by like reference numerals throughout the accompanying drawings.

Figure 1:
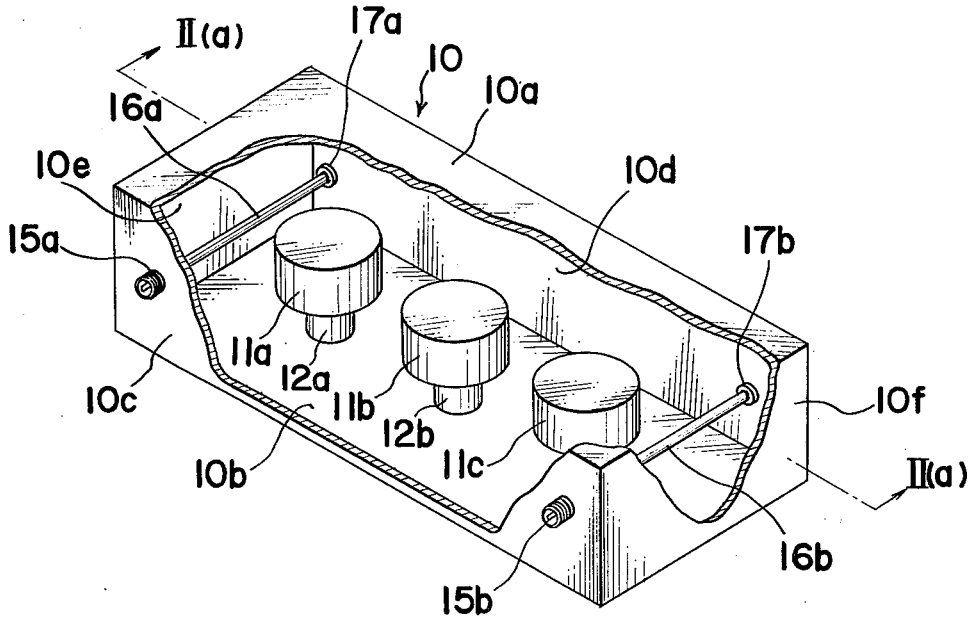
FIG. 1 is a perspective view of a band-pass filter partly broken away to show the arrangement of the dielectric resonator.

Referring first to FIG. 1, a microwave band-pass filter as shown comprises a casing 10 of substantially boxlike configuration made of any known metallic material such as brass, which casing 10 includes top and bottom walls 10*a* and 10*b*, a pair of opposed side walls 10*c* and 10*d* and a pair of end walls 10*e* and 10*f*. Although the walls 10*a* to 10*f* are shown as integrally joined together by machining a rigid metal block, the walls may be formed by metallic sheets or plates, with the neighboring walls being rigidly connected to each other, by the use of, for example, a plurality of screws.

Within the casing 10, one or more resonators, which are shown here as three in number and indicated by 11*a*, 11*b* and 11*c*, are mounted in a row on the bottom wall 10*b* on respective supporting spacers 12*a*, 12*b* and 12*c* and arranged in spaced and side-by-side relation with respect to each other. The supporting spacers 12*a* to 12*c* are made of any known electrically insulating material having a relatively low dielectric constant. The relation between the cylindrical resonators and the respective supporting spacers is described in detail later.

One of the opposed side walls 10*c* is provided at respective portions adjacent the opposed ends thereof with couplers 15*a* and 15*b* for connection with respective coaxial cables for microwave input and output transmission lines (not shown). These couplers 15*a* and 15*b* have axial terminals which are electrically insulated from the metal casing 10 and which are respectively connected with rods or probes 16*a* and 16*b* made of either electrically conductive material or dielectric material. The probes 16*a* and 16*b* in the instance as shown in FIG. 1 extend in parallel relation to the end walls 10*e* and 10*f* and are respectively positioned between the end wall 10*e* and the end resonator 11*a* and between the end wall 10*f* and the end resonator 11*c*. One of the opposed ends of each of the probes 16*a* and 16*b*, which is remote from the corresponding coupler 15*a* or 15*b*, is supported by the side wall 10*d* by means of a mounting piece 17*a* or 17*b* made of electrically insulating material such as polytetrafluoroethylene. The size of the casing 10, particularly of the inside thereof is a certain size which has a predetermined cutoff frequency.

Figure 2A:
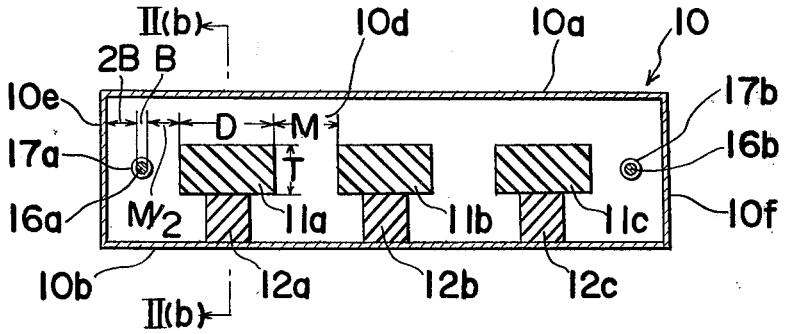
FIG. 2(*a*) is a sectional side view taken along the line II(*a*) — II(*a*) of FIG. 1.
Figure 2B:
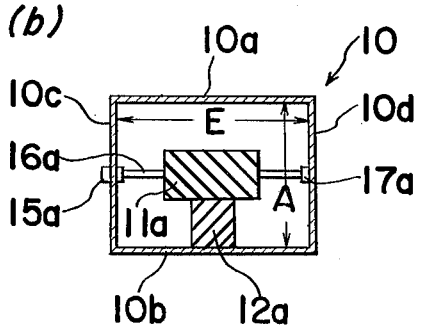

With particular reference to FIGS. 2(*a*) and 2(*b*), there are shown details of the microwave bandpass filter. The description hereinbelow is particularly directed to the first resonator 11*a* provided at the lefthand end as viewed in FIG. 2(*a*), and it is to be noted that other resonators 11*b* and 11*c* are formed in the same manner and have the same structure as the resonator 11*a*. The dielectric resonator 11*a* is made of a cylindrical block of any known dielectric material. The size of the cylindrical block is such that the diameter D thereof is a few centimeters, for example, in one type 1.45 cm, and the thickness T thereof is about half the size of the diameter D and is determined by the resonance frequency. Such a resonator as described above is fixedly bonded onto the cylindrical supporting spacer 12*a* which is in turn fixedly bonded on to the bottom wall 10*b*. The height of the supporting spacer 12*a* is such that the center of the resonator 11*a* bonded onto the spacer 12*a* matches the center of the depth A of the casing 10. The inner dimensions of the casing 10 are such that the depth A is within a range of 2T to 3T, while the width E, corresponding with the direction of extension of the probes 16*a* and 16*b*, is within a range of 2D to 3D. The distance measured along the longitudinal direction of the casing 10 is determined by the number of the resonators to be placed in the casing 10.

Still referring to FIG. 2(*a*), the three resonators 11*a*, 11*b* and 11*c* are spaced from each other a distance M which is normally within a range of D/2 to D, while the distance between the resonator 11*a* and the probe 16*a* and the distance between the resonator 11*c* and the probe 16*b* are both arranged to be M/2. Each of the probes 16*a* and 16*b* is spaced from end walls 10*e* and 10*f*, respectively, a distance within a range of B to 3B in which B is the diameter of the probe. It is to be noted that the axes of the probes 16*a* and 16*b* are in alignment with the centers of the resonators. Each of the dielectric resonators is made of ceramic mainly consisting of, for example, 22–43% of $TiO_2$, 38–58% of $ZrO_2$ and 9–26% of $SnO_2$. In addition to such materials, there may be included 0.5–10.0% of $La_2O_3$. It is to be noted that the percentage of each of the materials is given with respect to the weight of the resonator, and also that other combinations of materials may be employed for constructing the dielectric resonator. On the other hand, each of the supporting spacers is made of ceramic such as forsterite, steatite or porcelain, or otherwise may be made of synthetic resin. For the purpose of understanding a specific feature of the present invention, the combination of a dielectric resonator and supporting spacer bonded thereto is referred to as a dielectric resonator unit or simply as a unit, hereinbelow.

In order to obtain the resonator unit of the present invention, a combination of a particular dielectric resonator with a particular supporting spacer is carried out in the following steps as described in connection with FIG. 3.

Figure 3:
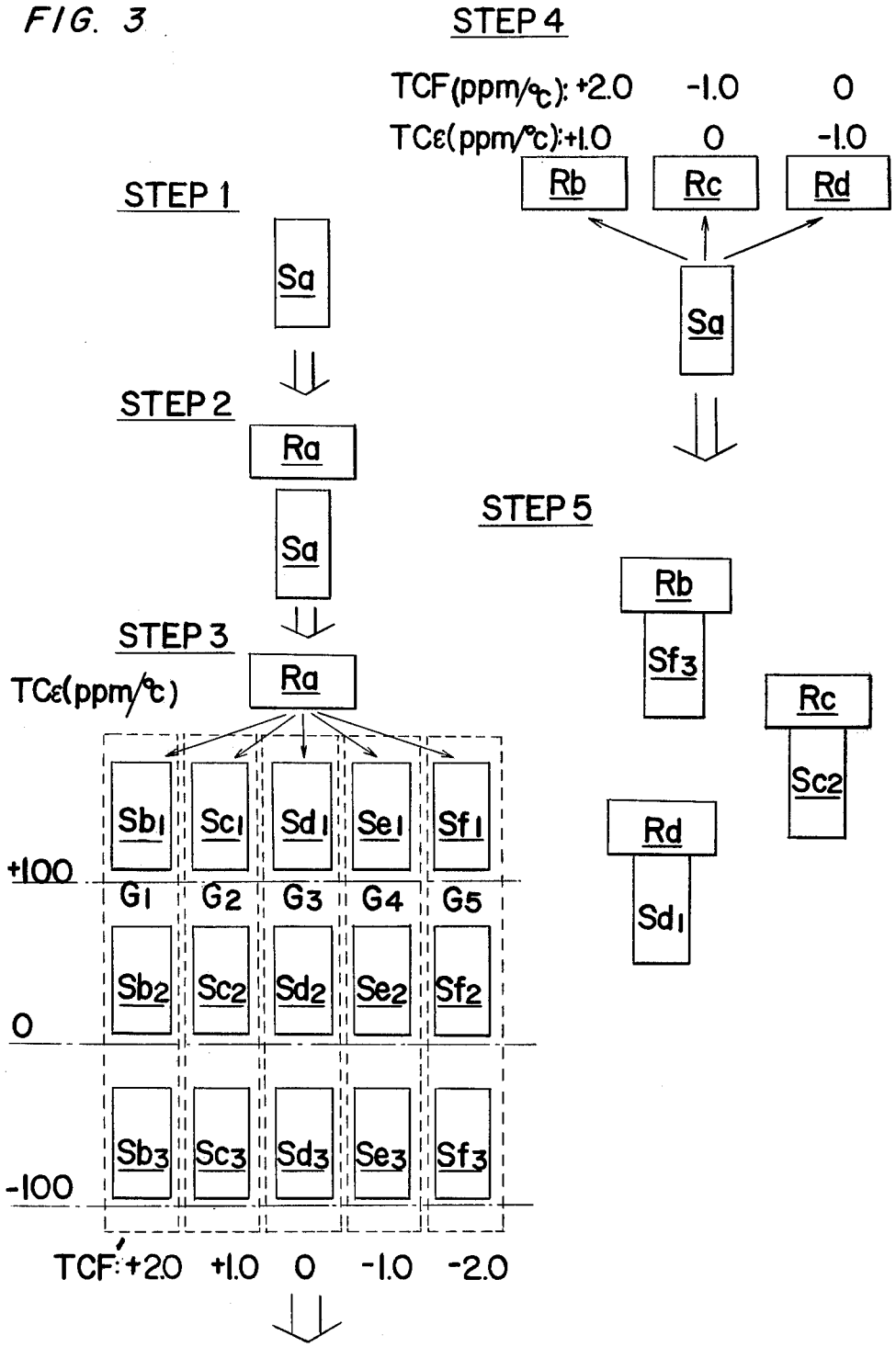
FIG. 3 is a schematic illustration showing the steps in the construction of a dielectric resonator unit according to the present invention.

Referring to FIG. 3, there are shown five main steps used to construct the resonator unit of the present invention.

In a first step, a supporting spacer Sa having an inherent TCε of 0ppm/° C. is prepared for employment as a basis for determining the inherent TCF of dielectric resonators which are obtained during manufacturing thereof. The TCF value of the supporting spacer itself is not taken into consideration, since the supporting spacer does not form any part of the resonator. However, upon coupling of the resonator with the spacer, the spacer may have some influence on the TCF value of the resonator.

In the second step, the supporting spacer Sa is coupled by a suitable securing screw or bonding, in turn, with various dielectric resonators in a casing such as the one shown in FIG. 2, so as to find a particular resonator Ra which has an inherent TCF of 0ppm/° C. within the same casing designed for a particular cutoff frequency. In order to select the resonator Ra, the composite TCF of the dielectric resonator unit formed by coupling the supporting spacer Sa with various dielectric resonators is measured for each unit, and then, when a unit with a composite TCF of 0ppm/° C. is found, the dielectric resonator employed in said unit will be known to have an inherent TCF of 0ppm/° C. The dielectric resonator Ra selected in the above described manner is used, in the next step, as a basis for determining the degree to which the TCF of a unit formed by combining the dielectric resonator Ra with various supporting spacers is influenced by the various spacers.

It is to be noted that the first and second steps as described above may be reversed. In other words, it is possible to prepare the dielectric resonator Ra having 0ppm/° C. of TCF within the particular casing as described above in the first step, so that in the second step, the dielectric resonator thus prepared is coupled, in turn, with various supporting spacers to find a particular supporting spcaer Sa which has a TCε of 0ppm/° C. In these first and second steps, the preparation of the particular supporting spacer Sa or the particular dielectric resonator Ra is achieved solely by measuring the values of the inherent TCF or TCε thereof, respectively, through any known method such as the so-called capacitance bridge method or electrode measuring method in which the dielectric resonator is sandwiched between two electrodes made of silver.

In the third step, the selected resonator Ra is coupled, in turn, with various supporting spacers and the TCF of units constructed by coupling the resonator Ra with each of the supporting spacers is measured. The measured TCF of the unit is given respectively to supporting spacers as an apparent temperature frequency characteristic (referred to as TCF' hereinbelow) to indicate the degree to which the TCF of the resonator unit is affected by the use of the respective supporting spacers. The illustration of step 3 in FIG. 3 shows various supporting spacers classified in different groups according to the measured TCF' groups, which are shown as five in number and are enclosed in dotted lines. The first group G1 shown in the left-most side in FIG. 3 has a TCF' of 2.0ppm/° C., while the other groups G2, G3, G4 and G5 have a TCF' of 1.0ppm/° C., 0ppm/° C., −1.0ppm/° C. and −2.0ppm/° C., respectively. In each group, for example, in group G1, there are included supporting spacers with different values of TCε, that is, supporting spacers Sb1, Sb2 and Sb3 in group G1 have a TCε of 100ppm/° C., 0ppm/° C. and −100ppm/° C., respectively. It is to be noted that the TCε of each supporting spacer is previously measured by a suitable known measuring means, so that it is necessary in this third step to measure only the TCF' of each of the supporting spacers. It is also to be noted that the TCF' can be measured with comparatively high accuracy, for example, on an order of one hundredth or one thousandth of one ppm/° C.

In a fourth step, the supporting spacer Sa is again combined, in turn, with various dielectric resonators in the same casing as described above for measuring the TCF of the respective dielectric resonators. The illustration of step 4 in FIG. 3 shows measured dielectric resonators Rb, Rc and Rd, with the measured TCF being 2.0ppm/° C., −1.0ppm/° C. and 0ppm/° C., respectively. It should be noted that the TCε of each of dielectric resonators has previously been measured.

In a fifth step, a dielectric resonator obtained in the fourth step, for example, the dielectric resonator Rb has an optimum supporting spacer selected therefor from the supporting spacers obtained in the third step. Since the dielectric resonator Rb has a TCF of 2.0ppm/° C., it is necessary to select the optimum supporting spacer from the group G5 of the supporting spacers having a TCF' of −2.0ppm/° C. Accordingly, if the dielectric resonator Rb is combined with any one of the supporting spacers in group G5 there will result a dielectric resonator unit with a TCF of 0ppm/° C. However, an optimum supporting spacer is selected from within group G5 to counterbalance the difference in TCε between the dielectric resonator Rb and the supporting spacer. Supposing that the coupling coefficient therebetween is 1/100 and that the dielectric resonator Rb has a TCε of 1.0ppm/° C., the optimum supporting spacer for the dielectric resonator Rb is the spacer Sf3 having a TCε of −100ppm/° C. The term coupling coefficient used here means the degree to which the TCε of the supporting spacers affects the combined dielectric resonator. Therefore, a TCε of −100ppm/° C. of the spacer Sf3 affects the dielectric resonator combined therewith to change the TCε of the resonator −1ppm/° C. Consequently, the thus obtained dielectric resonator unit including the dielectric resonator Rb and the supporting spacer Sf3 has a TCF and a TCε of substantially 0ppm/° C. when the unit is employed in the particular casing described above. In constructing the unit, the coupling between the dielectric resonator and the supporting spacer is achieved by a suitable securing screw or bonding. Such coupling must be effected under the same conditions as the condition of coupling effected in the previous steps 2–4, since different conditions of the coupling may result in a different coupling coefficient therebetween.

In a similar manner, other dielectric resonators such as those indicated by the reference characters Rc and Rd can be combined with an optimum supporting spacer which is selected from among the supporting spacers obtained through the third step.

In the case where it is necessary to control the TCF of the dielectric resonators so that it has a value of no more than a value on the order of 0.1ppm/° C., it is quite difficult to accomplish such control through control of the manufacture of the dielectric resonator itself. According to the present invention, however, such control can be accomplished easily by using a supporting spacer having a TCF' on the order of the 0.1ppm/° C. The control of TCF' of the supporting spacers so that it is on the order of 0.1ppm/° C. is comparatively easy, since the TCε of the supporting spacer does not have much influence on the TCε of the dielectric resonator. In other words, a change of TCε in the supporting spacer produces a change of only several tenths to several hundredths of the TCε of the dielectric resonator. For example, in a supporting spacer of one type, a change of 0.1ppm/° C. of the TCε of the dielectric resonator is obtained by a change of 10.0ppm/° C. change in the TCε of the supporting spacer where the coupling coefficient is 1/100.

Therefore, according to the present invention, the dielectric resonator units obtained by the steps 1 to 5 will have values of the TCF and TCε which are approximately 0ppm/° C., so that a temperature change has hardly any effect on the dielectric resonator units.

It is to be noted that the coupling coefficient between the dielectric resonator and the supporting spacer can be changed by a change of the area of contact therebetween or a change of dielectric constant or the TCε of the supporting spacer.

Although the present invention has been fully described by way of example in connection with the preferred embodiment thereof, it should be noted that various changes and modifications will be apparent to those skilled in the art. By way of example, the dielectric resonator unit according to the present invention can be used not only in a microwave band-pass filter referred to above, but also in any other microwave filters such as microstrip filters and waveguide filters which employ the dielectric resonator units constructed according to the present invention. In addition, even in the embodiment shown in FIG. 1, the dielectric resonator may be so altered as to have any other form such as cubic.

Therefore, these changes and modifications are to be understood as included within the scope of the present invention unless they depart therefrom.

What is claimed is:

1. A process for manufacturing a dielectric resonator unit for use in filtering microwaves, said dielectric resonator unit comprising a dielectric resonator having an inherent TCε and a supporting spacer having an inherent TCε and bonded onto said dielectric resonator so as to make the composite TCF of said dielectric resonator unit substantially equal to a predetermined value, TCε standing for the temperature coefficient of dielectric constant and TCF standing for the temperature coefficient of resonator frequency, said process comprising the steps of:

(a) preparing a reference supporting spacer having a reference value of the inherent TCε and a reference dielectric resonator having a reference value of the inherent TCF;

(b) coupling said reference dielectric resonator with each of a plurality of supporting spacers and measuring the apparent TCF of the respective supporting spacers as an indication of the degree to which the TCF of a dielectric resonator will be affected by each of the respective supporting spacers, and coupling said reference supporting spacer with each of a plurality of dielectric resonators and measuring the inherent TCF of the respective resonators; and (c) coupling one of said plurality of dielectric resonators with a selected one of said supporting spacers, said selected one of said supporting spacers having an apparent TCF which affects the inherent TCF of said dielectric resonator for making the composite TCF of the dielectric resonator unit substantially equal to said predetermined value.

2. A process as claimed in claim 1, wherein said step of preparing a reference dielectric resonator comprises:

(a) preparing a reference supporting spacer having reference value of the inherent TCϵ; and (b) coupling each of a plurality of dielectric resonators with said reference supporting spacer and measuring the composite TCF of the coupled resonator and spacer, and selecting the dielectric resonator having the desired reference value of the inherent TCF from among the resonators.

3. A process as claimed in claim 1, wherein said step of preparing a reference supporting spacers comprises:

(a) preparing a reference dielectric resonator having reference value of the inherent TCF; and (b) coupling each of a plurality of supporting spacers with said reference dielectric resonator and measuring the composite TCF of the coupled resonator and spacer, and selecting the supporting spacer having the desired reference value of the inherent TCϵ from among various supporting spacers.

4. A process as claimed in claim 1, wherein said reference value of the inherent TCϵ of said supporting spacer is 0ppm/° C.

5. A process as claimed in claim 1, wherein said reference value of the inherent TCF of said dielectric resonator is 0ppm/° C.

6. A process as claimed in claim 1, wherein said predetermined value is 0ppm/° C.

7. A dielectric resonator unit for use in filtering microwaves comprising a dielectric resonator, and a supporting spacer coupled to said dielectric resonator, said dielectric resonator unit having a composite TCF of a predetermined value, TCF standing for the temperature coefficient of resonance frequency, said dielectric resonator unit being made by a process comprising the steps of:

(i) preparing a reference supporting spacer having an inherent TCϵ of 0ppm/° C., TCϵ standing for the temperature coefficient of dielectric constant; and ii) coupling said reference supporting spacer with said dielectric resonator and measuring the inherent TCF of said dielectric resonator;

(iii) preparing a reference dielectric resonator having an inherent TCF pf 0ppm/° C.;

(iv) coupling said reference dielectric resonator with each of a plurality of supporting spacers and measuring the apparent TCF of the respective supporting spacers for indicating the degree to which the TCF of a reference dielectric resonator will be affected by each of the respective supporting spacers; and (v) selecting a supporting spacer from among said respective supporting spacers and coupling it with said dielectric resonator to form said dielectric resonator unit, the said selected supporting spacer having an apparent TCF which affect the TCF of said dielectric resonator for making the composite TCF of said dielectric resonator unit substantially equal to said predetermined value.

8. A dielectric resonator unit as claimed in claim 7, wherein said predetermined value is 0ppm/° C.

* * * * *